United States Patent [19]

Jaquay

[11] Patent Number: 4,909,060

[45] Date of Patent: Mar. 20, 1990

[54] OIL COMPRESSION COMPENSATION SYSTEM

[75] Inventor: Robert A. Jaquay, Pittsburgh, Pa.

[73] Assignee: United Engineering, Inc., Pittsburgh, Pa.

[21] Appl. No.: 148,639

[22] Filed: Jan. 26, 1988

[51] Int. Cl.[4] ..... B21B 31/22

[52] U.S. Cl. ..... 72/245; 91/361; 91/459; 72/8; 72/11; 72/20

[58] Field of Search ..... 72/245, 20, 19, 8, 11, 72/14; 91/361, 459

[56] References Cited

U.S. PATENT DOCUMENTS

| | | | |
|---|---|---|---|
| 3,427,839 | 2/1969 | Neumann | 72/245 X |
| 3,686,907 | 8/1972 | Sokolov et al. | 72/20 |
| 3,766,761 | 10/1973 | Adair et al. | 72/20 X |
| 4,102,171 | 7/1978 | Petry et al. | 72/245 |
| 4,537,077 | 8/1985 | Clark et al. | 91/35 X |
| 4,813,256 | 3/1989 | Engel | 72/245 X |

FOREIGN PATENT DOCUMENTS

| | | | |
|---|---|---|---|
| 2148546 | 3/1973 | France | 72/245 |
| 0076612 | 5/1984 | Japan | 72/245 |
| 0191453 | 1/1967 | U.S.S.R. | 72/245 |

*Primary Examiner*—W. Donald Bray

*Attorney, Agent, or Firm*—Parmelee, Miller, Welsh & Kratz

[57] ABSTRACT

A pre-set fluid actuator for setting the roll gap of a rolling mill having a transducer for detecting actuator movement and an electrohydraulic servovalve for controlling its position, a control system for compensating for the compressibility of the actuator fluid caused by the rolling force in a manner that requires no operation of the servovalve by creating a pre-set anticipating compression compensation signal and reducing the output of this signal by the output of a signal representing the actual fluid compression caused by the actual rolling force.

7 Claims, 1 Drawing Sheet

OIL COMPRESSION COMPENSATION SYSTEM

BACKGROUND OF THE INVENTION (a) Field of Invention

In many applications where fluid is employed as a power or energy medium, such as oil in a force applying or resisting hydraulic piston cylinder assembly, the inherent compressibility of the medium can create a serious disadvantage or limitation in the use of the device. Of course different mediums have different coefficients of compressibility and while in certain applications the design of the device can allow for the compressibility factor in others it presents a serious disadvantage resulting in curtailed use and/or expensive and inordinate auxiliary compensation equipment. For the purpose of explaining the present invention and not as a limitation of its application the well known problem of hydraulic actuators employed in strip or plate (strip) rolling mills to control the roll gap has been selected.

Many modern day rolling mills incorporate quick acting hydraulic piston cylinder assemblies (actuators) to control the gap between the work rolls and hence the gauge of the rolled product produced by the mill. Due to the fact that the actuator is usually arranged in the direct line of force of the rolling force to resist the force the amount or degree of the compressibility of the oil results in a "gauge error" since the compressibility allows the roll gap to be increased by the amount of the compressibility.

Because the gauge tolerance of rolled strip is generally very critical present mill designs have had to adhere to two additional design criteria, namely to keep the stroke of the actuator as small as possible and/or providing a control system to reposition the moveable element of the actuator to compensate for the element's movement due to the compressibility of the oil under the rolling force. Both of these criteria in many types of mills represent serious, if not prohibitive, limitations. Moreover, certain mill designs require long stroke actuators which in the past have necessitated some type of control system to compensate for the compressibility of the oil.

Such present day control systems employ some form of a position detector to detect fluid compression induced movement of the moveable element of the actuator which in turn requires the employment of an electrohydraulic servovalve unit. The systems in question usually operate under pressures of 4000 PSI in which the rolling force can range between 4,000,000 to 12,000,000 pounds for reduction mills, which means that considerable dynamic fluid energy and response time is inherently involved in effecting a correction for the compression of the fluid, more about which will be discussed later. The dynamics of this situation can result in the production of considerable off gauge rolled strip depending on the particular speed of the mill involved.

(b) Background Printed Information

Representative of prior publications discussing the concern of actuator compliance in rolling mill automatic gauge control systems (AGC Systems) may be found in U.S. Pat. Nos. 3,427,839 and 4,102,171 and in articles appearing in the "Iron and Steel Engineer" entitled Design and application of hydraulic gap control systems by Paul Huzyak et. al. - August, 1984, page 13 and Dynamic characteristics of automatic gauge control system with hydraulic actuators by Vladimir B. Ginzburg - January, 1984, page 57.

BRIEF SUMMARY OF THE INVENTION

The present invention relates to a medium compression compensation system for a force applying and/or resisting actuator in which unless compensated for the compressibility of the medium creates an adverse effect by allowing movement of the moveable element or elements of the actuator. Included in the system is a means for detecting and producing a signal representing the degree of movement of the moveable element from a pre-set no load position and unless otherwise negated effects a repositioning of the moveable element to its pre-set position, a means for pre-setting the position of the moveable element under a no load condition and providing a signal representative thereof including compensation for the compression of the medium under an anticipated load, and a means for determining the compression of the medium under a loaded condition and modifying the detected movement signal by the amount of the actual load determined condition.

In terms of a rolling mill or the like the normal undesired change in the roll gap caused by the compression of the oil in the actuator is quickly and efficiently compensated for without the operation of the electrohydraulic servovalve system by reason of the fact that the signal measuring the movement of the actuator due to the compression of the oil is prevented from effecting an operation of the servovalve because the system has built into it an anticipated pre-set compression factor which allows this factor to be modified by a factor representative of the compression of the oil caused by the actual rolling force.

DETAIL DESCRIPTION OF THE INVENTION

Figure 1:
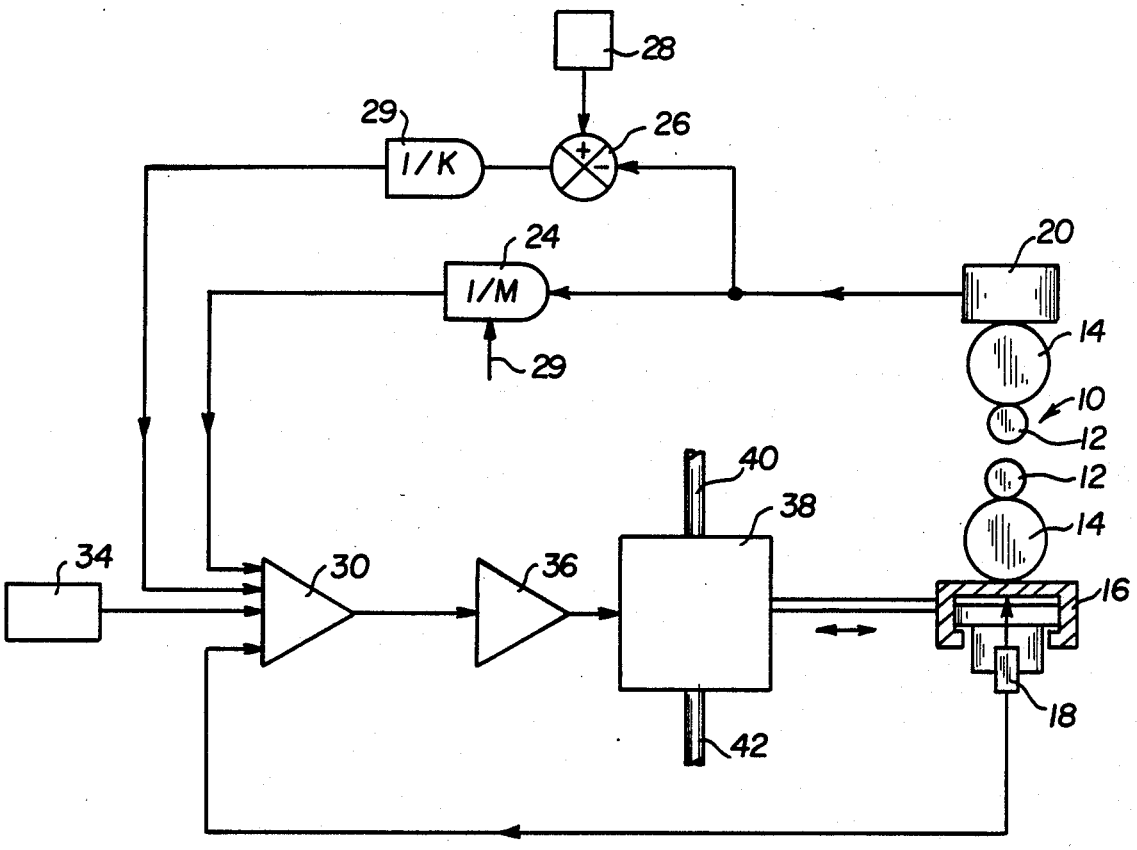
FIG. 1 is a schematic elevational view of a 4 Histrip rolling mill, particularly illustrating a roll gap setting fluid actuator and the fluid compression compensation system according to the present invention.

With reference to FIG. 1 there is illustrated some of the basic components of a well known 4 Hi strip rolling mill 10 for rolling metal strip including work rolls 12, backing-up rolls 14, hydraulic piston cylinder assembly 16 (actuator), including a position transducer 18 and lastly a load cell 20.

The combined hydraulic electric system that made up the control circuit of FIG. 1 and how the components are arranged and operated are also well known as indicated in the aforesaid mentioned published articles and for which reason will not be described in detail. Starting with the load cell 20, it feeds an electrical representative signal of the actual rolling force to a function generator 24 and to a summing amplifier 26, the latter comparing the actual rolling force signal with an anticipated rolling force signal produced by an electrical adjusting device 28. The function generator 24 also receive a signal 29 of an anticipated rolling force and divides alternatively either the actual or anticipated rolling force by the value representing the modulus of the mill to produce a signal representing the mill stretch (1/M) in accordance with the well known load meter AGC formula $G=H-F/M$ where:

G=rolled gauge.

H=no load roll setting.

F/M=actual or anticipated roll force divided by a constant representing the mill modulus.

The summing amplifier 26 sends its signal to the function generator 29 where it is divided by a factor 1/K representing the actuator compliance value to produce a signal equal to the oil compression (Xoc), which signal is received by a control amplifier 30.

This signal will take two different forms i.e. two alternative signals, depending on whether or not an actual rolling force is being produced, i.e. a signal (Fant−o) representing an anticipated rolling force value or (Fant−Fact) representing the difference between actual rolling force value and an anticipated rolling force value, discussed later in connection with equation 1. As noted in the above referred to published articles - actuator compliance is a well known technology and may take into account a number of factors depending on the degree of sophistication required, more about which will appear below.

Returning to FIG. 1, the position transducer 18 associated with the actuator 16 for detecting movement of its piston produces a signal representative thereof which is fed to the control amplifier 30. In addition to the three signals already identified being received by the amplifier 30, it also receives a signal (H) from an adjusting device 34 representing the desired gauge of the strip to be rolled by the mill. The control amplifier 30 feeds it signal to a power amplifier 36 which in turn sends a signal to an electrohydraulic directional servovalve 38 having the customary supply inlet at 40 and return at 42. The servovalve may be several well known types, for example a Moog Series 72 High Flow Two-stage servovalve sold by the Moog Controls Division of Moog Inc., N.Y. U.S.A.

The servovalve 38 feeds in a controlled manner to the actuator 16. As in the case of the servovalve, the other components of the electrohydraulic control system, and their operation in an AGC system, are all well known as indicated by the above referred to patents and articles. It will also be recognized that the control system is essentially a standard load meter AGC system which has been modified to incorporate the teaching of the present invention. A better appreciation of this incorporation of the present invention can be gained by considering the following two equations:

$$Xoc=(Fant-Fact)/K \quad \text{: equation} \quad 1$$

where:

Xoc=oil compression compensation.

Fant=anticipated rolling force.

Fact=actual rolling force.

K=constant for the actuator compliance.

According to equation 1 the oil compression compensation factor is equal to the anticipated rolling force minus the actual rolling force divided by the actuator compliance. In referring to FIG. 1, the Fant value is produced by the adjusting device 28 which value is employed by the summing amplifier 26 and the function generator 29 to produce the Xoc value i.e. the function generator 29 in combination with the summing amplifier 26 solves equation 1.

The second equation is expressed as:

$$G=H-Fant/M-Xoc \quad \text{: equation} \quad 2$$

where the new terms have the following meaning:

G=desired gauge to be rolled.

H=no load roll setting.

M=constant factor for the mill modulus.

The function generator 24 produces two alternative signals i.e. Fant/M or Fact/M by multiplying the rolling force signals by the constant 1/M representing the mill stretch factor. Thus function generator 24 produces the factor Fant/M of equation 2 employed for the presetting roll gap operation.

The position control amplifier 30 thus solves equation 2 and in cooperation with the power amplifier 36 controls the operation of the servovalve 38 to set i.e. pre set the initial no load roll gap setting of the mill 10, which setting will have two negative values, one representing a computed value for the mill stretch for an anticipated rolling force and the other representing a computed value for the oil compression compensation for the same anticipated rolling force. Without requiring any further operation of the hydraulic components to compensate for compression of the oil and of equal importance requiring no corrective operation during rolling by such components the present invention effects a compensation quickly and efficiently by the simple operation of the summing amplifier 26 and the function generator 29. Accordingly, when the strip enters the mill bite and the rolling force begins to build up, the computed value Xoc will be progressively reduced by the reference signal equal to the amount of the actual compression of the oil as computed by the units 26 and 29. In effect the signal from the position transducer 18 which measures the movement of the piston of the actuator 16 and produces a signal requiring corrective operation on the part of the control amplifier 30 and servovalve 38 is progressively negated by an amount representing the progressive increase in compression of the oil as a function of the increases in the rolling force. As a result, the position control amplifier 30 is not called on to effect an operation of the actuator 16 thereby eliminating all of the attendant disadvantages.

In certain applications, the value Xoc during the initial rolling phase will be preferably produced between the time period when the strip begins to enter the roll bite until it is fully in the roll bite, for example a period of approximately 16 milliseconds. Also the Xoc value can be recalculated or updated periodically, in the case of the above example approximately every 4 milliseconds.

The following comments have reference to the derivation of the actuator compliance (stiffness) used in the oil compression compensation equation. Actuator stiffness is a function of the actuator stroke as can be seen in the following equation:

$$K=(2\times A^2\times B)/(V+A\times S) \quad \text{: equation} \quad 3$$

The stiffness equation represents two single acting actuators acting in parallel where:

S=actuator stroke, in.

A=actuator area, $in^2$.

V=volume of oil in the line between valve and actuator, $in^3$.

B=oil modulus, psi.

From the oil compression compensation equation:

$$S=Z-H+F/M+F/K \quad \text{: equation} \quad 4$$

where:

Z=actuator stroke when mill is "zeroed".

H=strip thickness.

F=anticipated force.

M=mill modulus.

Substituting equation 4 into equation 3 and rearranging yields:

$$K = \frac{A \times M \times (2 \times A \times B - F)}{V \times M + A \times (M \times (Z - H) + F)}$$

If the valve is mounted on the actuator, then $$A \times (M \times (Z - H) + F) >> V \times M$$

and the immediately above equation reduces to:

$$K = \frac{M \times (2 \times A \times B - F)}{M \times (Z - H) + F}$$

Relating the immediately above equation to an example, assumed in which the following is:

actuator diameter=38 inch.

actuator stroke at mill "zero", Z=5.00 inch.

mill modulus, M=30,000,000 lbs/inch.

oil modulus, B=180,000 lbs/in$^2$.

anticipated force, Fant=8,000,000 lbs.

product thickness, H=0.5 inch.

the servovalve is mounted on the actuator, V=0.

actuator area, A=1134.1 in$^2$.

actuator stiffness, K=84,000,000 lbs/inch.

oil compression factor, Xoc=( Fant−Fact ) / K equation 1.

when Fact=0 , Xoc=0.095 inches.

The initial gap reference, G is:

G=H−Fant/M−Xoc equation 2=0.138 inches.

The following chart shows the changes in the roll gap and the actuator reference as the strip enters the mill and the rolling force, (Fact) increases up to the point where the strip is completely in the mill employing an eight discrete unit updating program.

| Fact | Fact/M | Fact/K | Actual Gap | Actuator Ref. |
|---|---|---|---|---|
| $0 * 10^6$ | .000 | .000 | .138 | 4.862 |
| $1 * 10^6$ | .033 | .012 | .183 | 4.850 |
| $2 * 10^6$ | .067 | .024 | .229 | 4.838 |
| $3 * 10^6$ | .100 | .036 | .274 | 4.826 |
| $4 * 10^6$ | .133 | .048 | .319 | 4.815 |
| $5 * 10^6$ | .167 | .060 | .365 | 4.802 |
| $6 * 10^6$ | .200 | .071 | .409 | 4.791 |
| $7 * 10^6$ | .233 | .083 | .454 | 4.779 |
| $8 * 10^6$ | .267 | .095 | .500 | 4.767 |

From the chart it can be readily observed the results of the employment of the present invention by noting, (1) actuator ref. 4.862=0.5000−0.138 i.e. ( Z−G ), (2) that the changes in the actuator reference value of 4.767 equals the actuator reference 4.862−0.095, the Fact/K value, and (3) that the only correction required to be made by the actuator is the 0.267 Fact/M value since the compression of the oil is self compensated for, it being appreciated that the Fact/M term is compensated for in the gauge-meter equation. i.e. equation 2.

Figure 2:
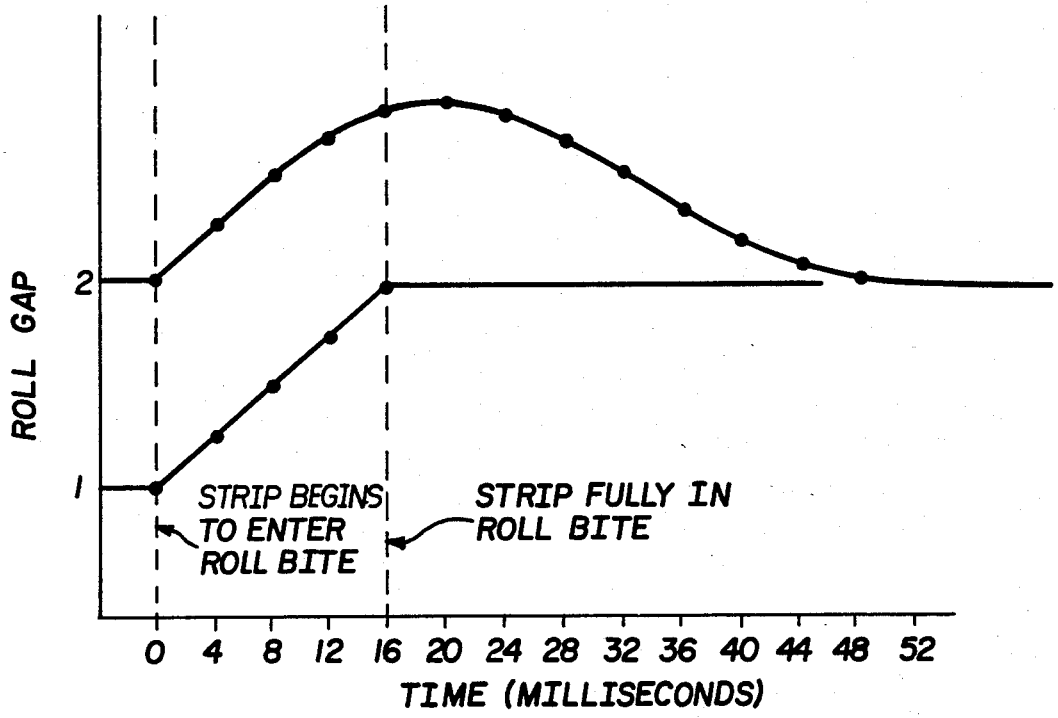
FIG. 2 is a graph illustrating the change in roll gap due to oil compression, the upper most representing one form of the prior art and the lower most one form of the present invention.

The immediately above discussion may be better understood by referring to FIG. 2. As noted the curve 2 plots time against changes in the roll gap during the initial rolling period between the time period when the strip begins to enter the roll bite until it is fully in the roll bite where there is no compensation for oil compressibility as practiced by the present invention. Without such compensation the servovalve attempts to effect a compensation by adding oil to the actuator therefore performance is based on the operation of the servovalve and the response time of the system as portrayed by curve 2 in FIG. 2.

In counterdistinction, curve 1, representing the present invention, the initial roll gap includes a pre-set pre-calculated compensation value for the compressions of the oil (Xoc), in which the curve illustrates three important achieved advantages, (1) the substantial reduction in time to effect compensation for oil compression and hence reduction in attendant off gauge rolled product, (2) reduction in the time the maximum adverse roll gap change is reached also reducing off gauge product and (3) requires no need to add oil to the actuator and therefore performance is not based on the operation of the servovalve or system response time.

It will be appreciated by those skilled in the art that the principles of the present invention can be practiced in many other applications and forms than disclosed and may be modified to adapt to such applications and forms without departing from the scope thereof.

What I claim is:

1. In a rolling mill having a workpiece roll gap and a fluid actuator for setting the roll gap, said actuator having a fluid head, a control system comprising:

means for controlling the operating position of said actuator including means for producing a signal representative of a change from the operating position, means for producing a signal representative of the anticipated compression of the fluid head when subject to an anticipated rolling force, means for receiving said anticipated compression signal to produce a pre-set anticipated compression compensation signal representative of a desired pre-set position of said actuator and hence said roll gap before the mill is subject to a rolling force, and for effecting through said position controlling means said desired position of said actuator in accordance therewith, means for producing a calculated signal representative of the compression of the fluid head caused by the actual rolling force produced after the leading end of the workpiece enters said roll gap, and means for reducing said pre-set signal by the amount of said calculated signal thereby to offset said signal representative of a change from said desired position of the actuator caused by compression of the fluid head by the actual rolling force.

2. A control system according to claim 1, wherein said anticipated compression signal and said calculated signal are obtained by the equation:

Xoc=(Fant−Fact) / K where:

Fant is the anticipated rolling force;

Fact is the actual rolling force, and

K is the actuator compliance constant.

3. A control system according to claim 2, wherein said pre-set signal is obtained by the equation:

G=H−Fant/M−Xoc where:

H is the desired roll gap;

Fant is the anticipated rolling force;

M is the spring constant of the mill, and

Xoc is the fluid compression compensation factor.

4. A control system according to claim 1, wherein said means for controlling the operation of said actuator includes a fluid servo means and a position transducer and wherein said actuator has a moveable element for establishing said operating position and said position transducer is arranged to detect movement of said moveable element.

5. A control system according to claim 1, wherein said means for producing said calculated signal includes means for making several different calculated signals during a predetermined time period between the time the leading end of the workpiece begins to enter said roll gap until the leading end is completely in said roll gap.

6. A control system according to claim 1, wherein said anticipated compression and said calculated signals represent an axial dimensional characteristic of said fluid head.

7. In a fluid compression compensation system for a pre-set actuator, means for controlling the operating position of said actuator including means for producing a signal representative of a change from the operating position, means for receiving said anticipated compression signal to produce a desired pre-set signal representative of a pre-set anticipated compression compensation desired position of said actuator before the actuator is subject to an actual load, and for effecting through said position controlling means said desired position of said actuator in accordance therewith, means for producing a calculated signal representative of the compression of the fluid cause by the actual load said anticipated signal and said calculated signal being obtained by the equation:

$$X_{oc}=(L_{ant}-L_{act})/C$$

where:

$L_{ant}$ is the anticipated load;

$L_{act}$ is the actual load, and

C is the actuator compliance constant; and means for reducing said pre-set signal by the amount of said calculated signal thereby to offset said signal representative of a change from said desired position caused by the actual load.

* * * * *